US006776479B2

(12) United States Patent
Ardito et al.

(10) Patent No.: US 6,776,479 B2
(45) Date of Patent: Aug. 17, 2004

(54) FLUID INTERCONNECT PORT VENTING FOR CAPILLARY RESERVOIR FLUID CONTAINERS, AND METHODS

(75) Inventors: Michael S. Ardito, Lebanon, OR (US); Anthony D. Studer, Albany, OR (US); Curt G. Gonzales, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/284,736

(22) Filed: Oct. 31, 2002

(65) Prior Publication Data

US 2004/0085413 A1 May 6, 2004

(51) Int. Cl.[7] ..... B41J 2/175
(52) U.S. Cl. ..... 347/86; 347/85
(58) Field of Search ..... 347/84, 85, 86, 347/87

(56) References Cited

U.S. PATENT DOCUMENTS

| | | | | | |
|---|---|---|---|---|---|
| 5,182,581 | A | * | 1/1993 | Kashimura et al. | 347/87 |
| 5,237,342 | A | * | 8/1993 | Saikawa et al. | 347/87 |
| 5,448,274 | A | * | 9/1995 | Hirabayashi et al. | 347/86 |
| 5,781,213 | A | * | 7/1998 | Ujita et al. | 347/86 |
| 5,784,088 | A | * | 7/1998 | Ujita et al. | 347/86 |
| 6,652,080 | B2 | * | 11/2003 | Childs et al. | 347/85 |

* cited by examiner

*Primary Examiner*—Anh T. N. Vo
(74) *Attorney, Agent, or Firm*—Larry Baker

(57) ABSTRACT

Venting mechanisms are provided for allowing air to replace fluid in the sealed fluid interconnect port of a container substantially filled with a capillary material, thus enabling absorption of residual fluid into the container capillary material. In one embodiment, the venting mechanisms include small ribs formed on the floor of the container body to space the capillary material away from the floor, thus allowing air to flow along the container floor to the interconnect port.

18 Claims, 5 Drawing Sheets

FLUID INTERCONNECT PORT VENTING FOR CAPILLARY RESERVOIR FLUID CONTAINERS, AND METHODS

The present invention relates generally to replaceable fluid containers, and exemplary embodiments of the invention relate more specifically to mechanisms for preventing residual ink from accumulating in the sealed fluid interconnect port of a replaceable ink container.

BACKGROUND OF THE INVENTION

Ink jet printers are well known in the art. The most common type of ink jet printer uses thermal excitation of the ink to eject droplets through tiny nozzles, or orifices, onto a print media. Other ink jet mechanisms, such as the use of piezoelectric transducers as ink droplet generators, are also well understood. With all ink jet technologies, the ink jet pen is typically mounted on a carriage which is scanned across the print media; dot matrix manipulation of the droplets provides alphanumeric character and graphics printing capabilities. To provide a color printing capability, pens for each primary color (such as cyan, magenta, and yellow) are commonly used, typically in addition to black.

The ink jet pen itself may have a self-contained reservoir for storing ink and providing appropriate amounts of ink to the printhead during a printing cycle. These self-contained pens are commonly referred to in the art as print cartridges. If reusable, semi-permanent pens rather than print cartridges are employed, ink is either supplied from a remote off-axis (or off-board) ink reservoirs, or the ink reservoirs are mounted on the carriage with the pens.

In a typical ink jet printing system with semi-permanent pens and replaceable ink supplies, the replacement ink supplies are generally provided with seals over the fluid interconnects to prevent ink leakage and evaporation, and contamination of the interconnects during distribution and storage.

One form of replaceable ink jet ink container comprises a rigid container substantially filled with a capillary foam material, with a fluid interconnect port located at the bottom of the container. Fluid connection from the ink container to the printhead is made through a tower having a fine screen at its apex, which passes through the fluid interconnect port and presses against the capillary material. At the time of manufacture and prior to filling the container with ink, the fluid interconnect port of the container may be sealed with a sealing tape, which is removed by a consumer prior to installing the ink container in a printer.

A problem encountered with the use of sealing tape on fluid interconnects in this type of container is that residual ink may be present in the sealed fluid interconnect port, which was either deposited there during the container fill process, or was forced out of the capillary material when the container was dropped during shipping and handling. Particularly with pigmented inks, residual ink in the fluid interconnect port may be resistant to re-adsorption into the capillary material. When the sealing tape is removed for installation of the ink supply into the printer, the residual ink may contact the fingers or clothing of the installer, or be flung off the tape. Care must therefore be exercised when removing the sealing tape to avoid contact with any residual ink. The residual ink may also react with the adhesive on the sealing tape, contaminating the ink in the container; or in multi-colored ink containers, one color of ink may contaminate another.

There is therefore a need for mechanisms which reduce the occurrence of residual fluid in the fluid interconnect region of a replaceable container.

SUMMARY OF THE INVENTION

Venting mechanisms are provided for allowing air to replace fluid in the sealed fluid interconnect port of a container substantially filled with a capillary material, thus enabling absorption of residual fluid into the container capillary material. In one embodiment, the venting mechanisms include small ribs formed on the floor of the container body to space the capillary material away from the floor, thus allowing air to flow along the container floor to the interconnect port.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
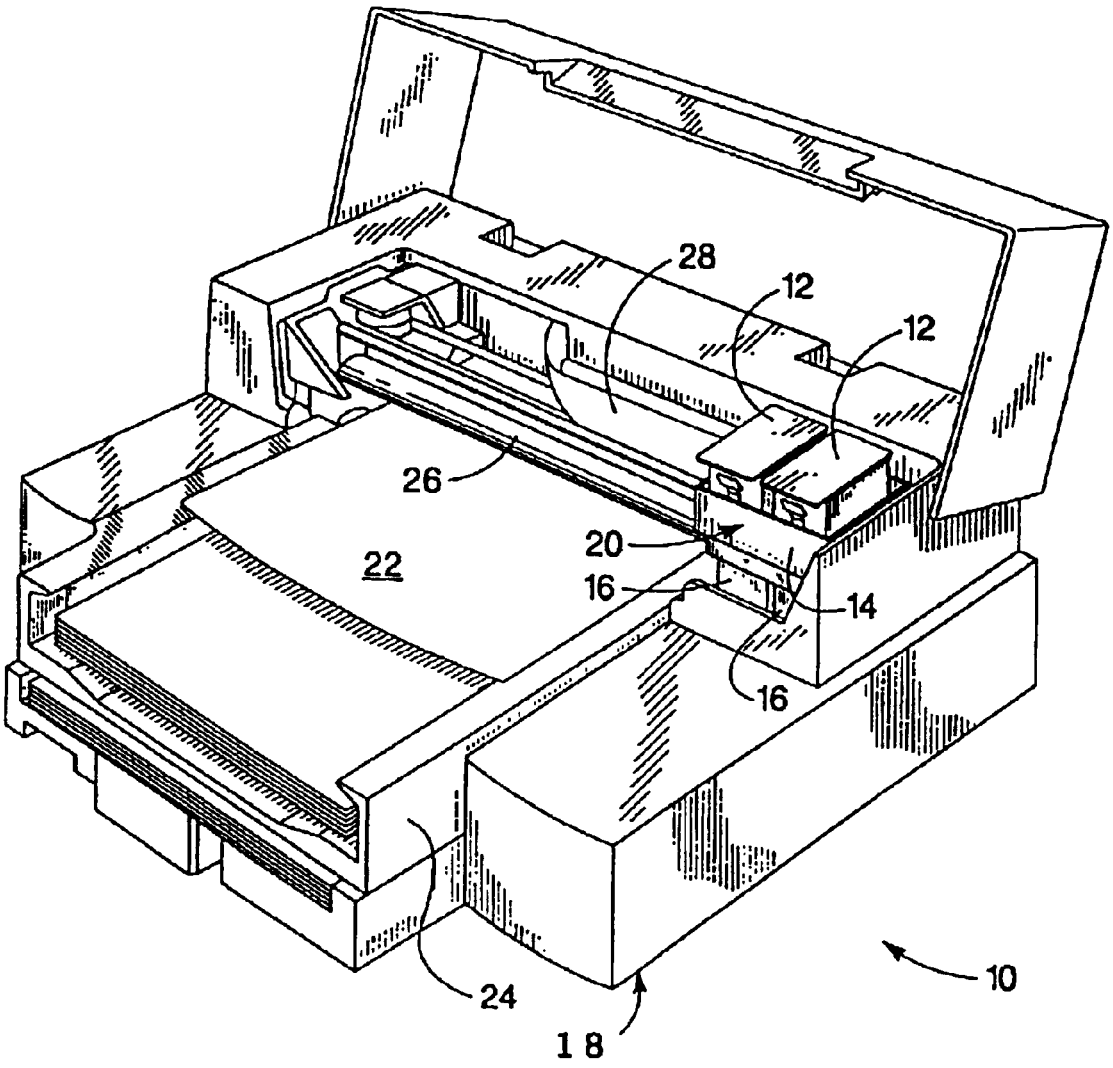
FIG. 1 is a perspective view of an exemplary ink jet printing system in which ink containers incorporating the fluid interconnect port venting features of the present invention may be utilized.

FIG. 1 is a perspective view of a typical ink jet printing system 10 shown with its cover open. The printing system includes a plurality of replaceable ink containers 12 that are installed in a receiving station 14. Ink is provided from the replaceable ink containers 12 through a manifold (not visible in this view) to inkjet printheads 16. The inkjet printheads 16 are responsive to activation signals from the printer portion 18 to deposit ink on print media. As ink is ejected from the printheads 16, the printheads are replenished with ink from the ink containers 12. The ink containers 12, receiving station 14, and inkjet printheads 16 are each part of a scanning carriage that is moved relative to a print media 22 to accomplish printing. The printer portion 18 includes a media tray for receiving the print media 22. As the print media 22 is stepped through a print zone, the scanning carriage 20 moves the printheads 16 relative to the print media 22. The printer portion 18 selectively activates the printheads 16 to deposit ink on print media 22 to thereby print on the media.

The scanning carriage 20 is moved through the print zone on a scanning mechanism which includes a slide rod 26 on which the scanning carriage 20 slides as the scanning carriage 20 moves through a scan axis. A positioning means (not shown) is used for precisely positioning the scanning carriage 20. In addition, a paper advance mechanism (not shown) is used to step the print media 22 through the print zone as the scanning carriage 20 is moved along the scan axis. Electrical signals are provided to the scanning carriage 20 for selectively activating the printheads 16 by means of an electrical link such as a ribbon cable 28.

Figure 2:
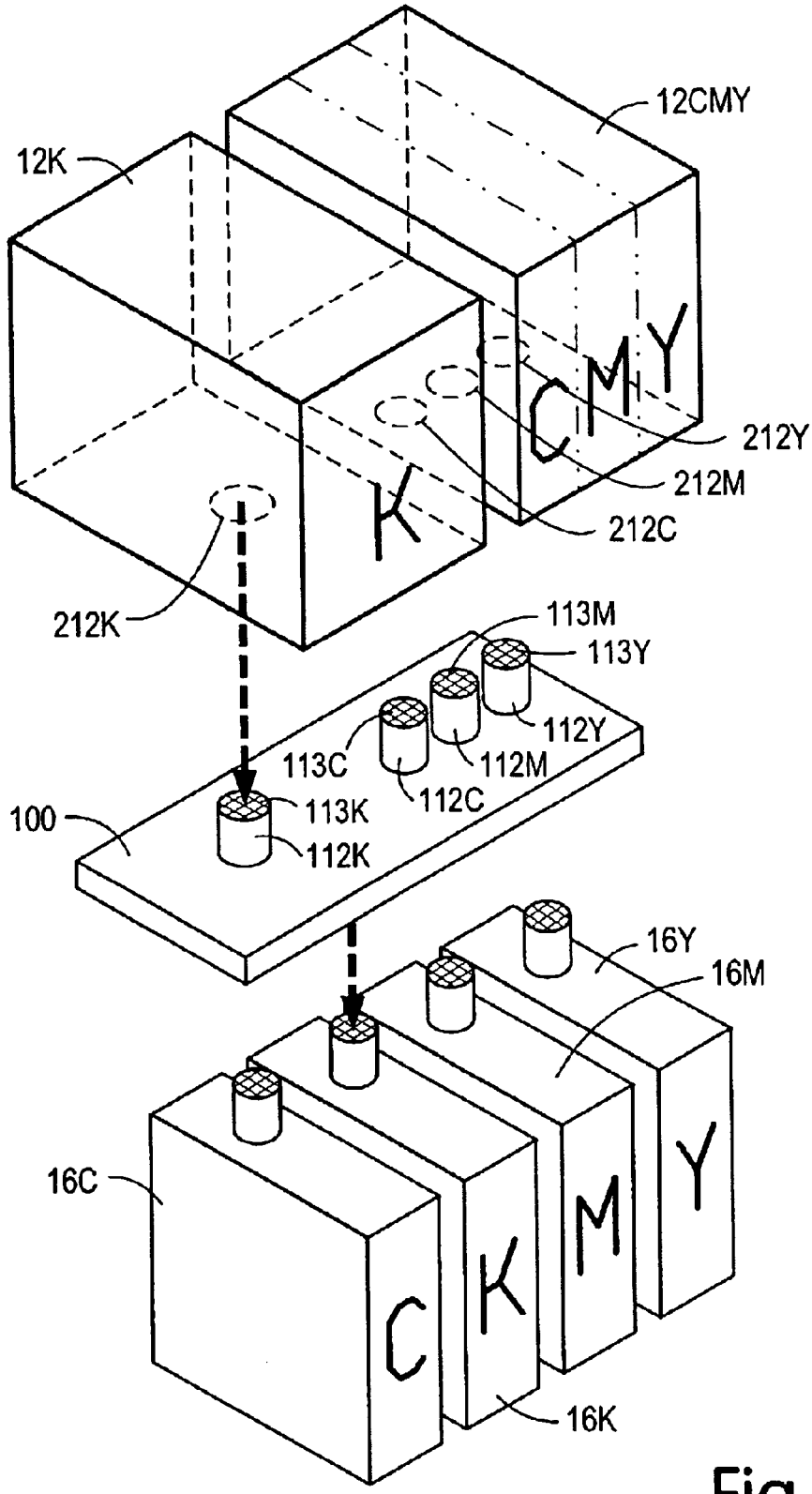
FIG. 2 is a simplified representation of the ink supplies, coupling manifold, and printheads of an exemplary ink jet printing system.

FIG. 2 is a simplified diagram further illustrating the scanning portion of an exemplary ink delivery system (for clarity, the supporting structure of the scanning carriage 20 is omitted). In the exemplary printing system, a pair of replaceable ink containers 12, typically one for black ink and one for color ink, are installed in the receiving station 14. The ink containers are substantially filled with a hydrophilic capillary material, as discussed below, which serves to retain the ink. Attached to the base of the receiving station is a manifold 100. Inkjet printheads 16 are in fluid communication with the receiving station 14 through the manifold. In the embodiment illustrated, the inkjet printing system includes a tri-color ink container 12CMY containing three separate ink colors (cyan, magenta, and yellow) and a second ink container 12K containing black ink. The replaceable ink containers 12CMY, 12K can be partitioned differently to contain fewer than three ink colors or more than three ink colors if more are required. For example, in the case of high fidelity printing, frequently six or more colors may be used.

The specific configuration of ink reservoirs and printheads illustrated in FIG. 2 is one of many possible configurations. Towers on the manifold 112K, 112C, 112M, 112Y, engage the fluid interconnect ports 212K, 212C, 212M, 212Y of the replaceable ink supplies. The towers include fine mesh filters 113K, 113C, 113M, 113Y at their apexes which contact the capillary material within the ink containers (not shown in FIG. 2) to establish a reliable fluid interconnect. Internal channels within the manifold (not shown) route the various ink colors to the appropriate printheads 16K, 16C, 16M, and 16Y (for illustrative purposes the path followed by the black ink is illustrated with a thick dashed line).

Figure 3:
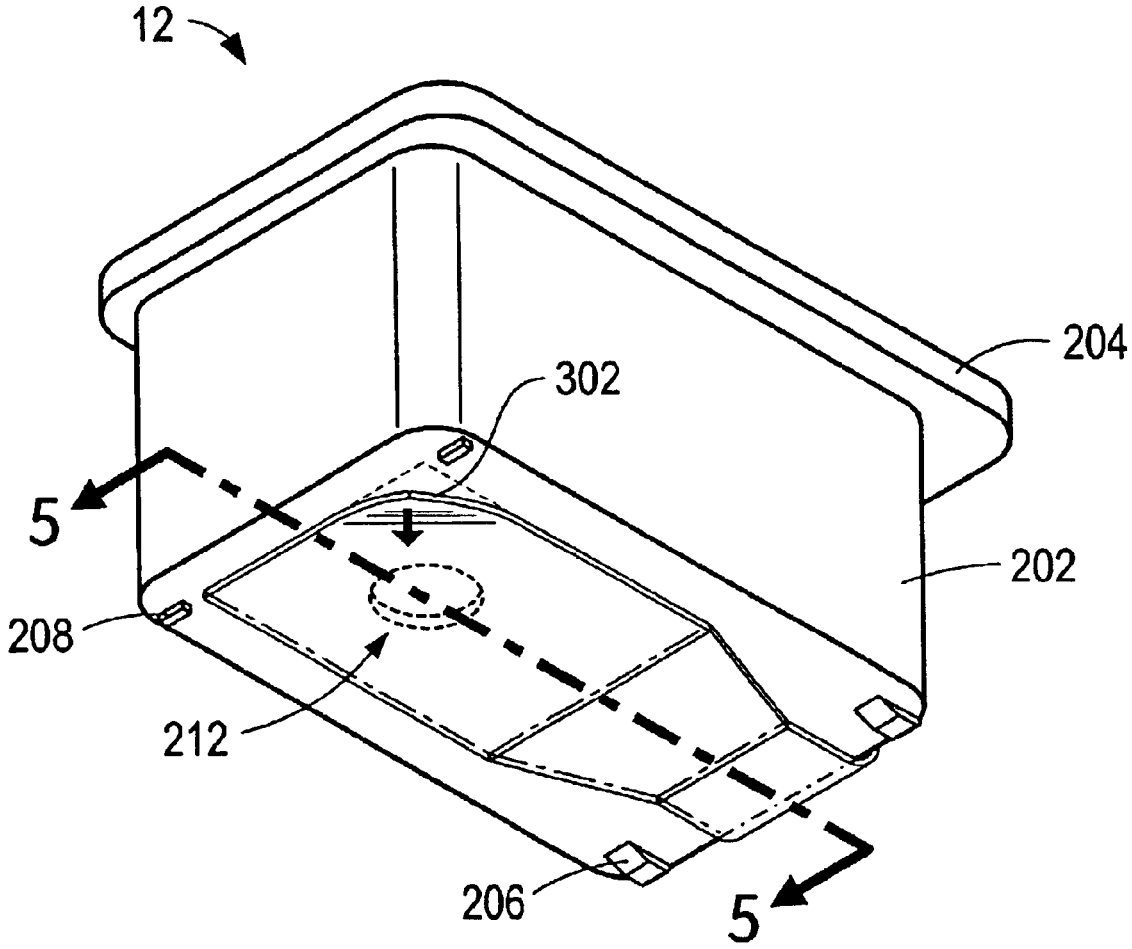
FIG. 3 a simplified representation of an exemplary replacement ink supply, illustrating how sealing tape may be placed over the fluid interconnect during manufacture.

FIG. 3 is a simplified representation of a replacement ink container 12, illustrating how a removable sealing tape or label 302 may be used to seal the fluid interconnect port 212 for transport and storage (the ink container illustrated is a single color container, such as would typically be used for black ink; however, embodiments of the present invention may also be utilized in multi-ink containers). The exemplary container comprises a body portion 202 and a lid portion 204. The body portion contains a hydrophilic capillary material (not visible in FIG. 3) to retain ink, such as bonded polyester fiber (BPF), polyurethane, or melamine. Small front spacing members or feet 208 and rear spacing members or feet 206 prevent the fluid interconnect port from contacting a flat surface on which the container is resting, such as a customer's desk, and potentially depositing residual ink (after seal 302 has been removed). The rear feet 206 may also form part of the venting mechanisms of the present invention, as discussed below.

Typically the seal 302 is attached with a mild adhesive that permits the seal or label to be easily removed by the consumer. As the seal is removed from the container, any residual ink in the fluid interconnect port or on the back side of the label or seal may come into contact with the installer's fingers or clothes, or may be flung from the label. Prolonged interaction between residual ink and the adhesive on the seal can also affect properties of the ink, potentially degrading print quality. With multi-color reservoirs, it is also possible for one color of ink to contaminate another color due to prolonged ink contact with the label adhesive.

Residual ink in the sealed fluid interconnect port is reduced or eliminated in embodiments of the present invention by enabling the ink to absorb into the capillary material within the ink container. The present invention provides venting mechanisms channeling air from outside the container to the fluid interconnect port, which facilitates adsorption.

Figure 4:
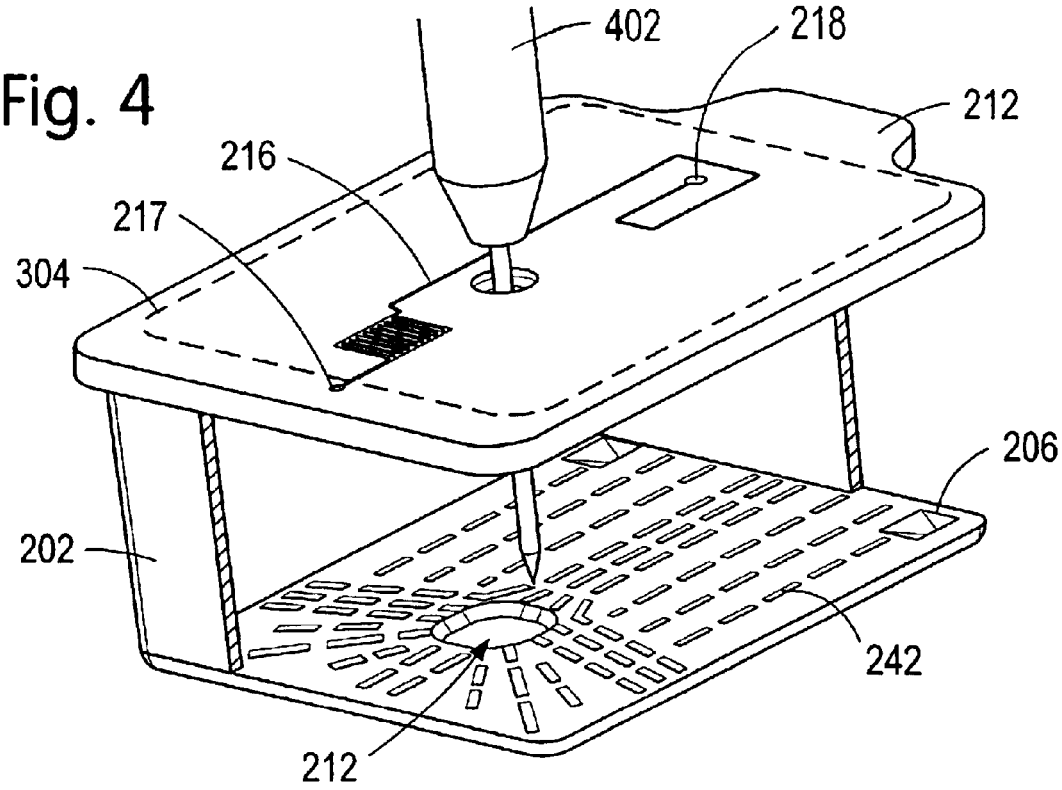
FIG. 4 is a partial cutaway view of an exemplary ink jet container during the "fill" process, illustrating an embodiment of the fluid interconnect port venting features of the present invention.

FIG. 4 is a partial cutaway view of an exemplary ink jet container during the "fill" process, illustrating an embodiment of the fluid interconnect port venting features of the present invention (the capillary material in the container is omitted for clarity). The container is shown together with a fill needle 402, indicating how ink is initially introduced into the container. A preferred embodiment of the present invention includes a vent system formed in the container lid (217, 216, 218), as is known in the art; provisions for allowing air passage around the end of the capillary material; and small ribs 242 formed in the floor of the container to space the capillary material away from floor, thus allowing vent air to reach the fluid interconnect region Each of these features is discussed in detail below.

Rigid ink containers are typically vented in some fashion to allow air to replace ink in the container as the ink is depleted and to maintain a suitable operating pressure in the container (another form of container uses a flexible bag that collapses as the ink is utilized). One form of vent is a very small passageway, usually serpentine, which allows air to slowly enter the container while effectively blocking the ink, due to the ink's surface tension.

FIG. 4 illustrates one exemplary approach to venting a fluid container. A narrow serpentine depression 216 is molded on the surface of the container lid connected at one end with a shallow depression 217, and at the other end with a hole 218 passing through the lid. After the container is filled with ink and the fill needle removed from the fill hole, a top label 304 (shown in dashed lines in FIG. 4) is affixed to the lid, serving to seal the fill hole and close the open side of the serpentine depression, thus forming a serpentine vent path 216 leading from the shallow depression 217 to the hole 218. External ambient air may pass from the shallow depression (which is not covered by the label 304), along the serpentine path 216 under the label 304, and through the hole 218 into the container interior. Although a single vent is illustrated, multiple vents may also be used. Other approaches to venting the ink container may also be employed; such as, for example, other forms of serpentine vents.

Figure 5:
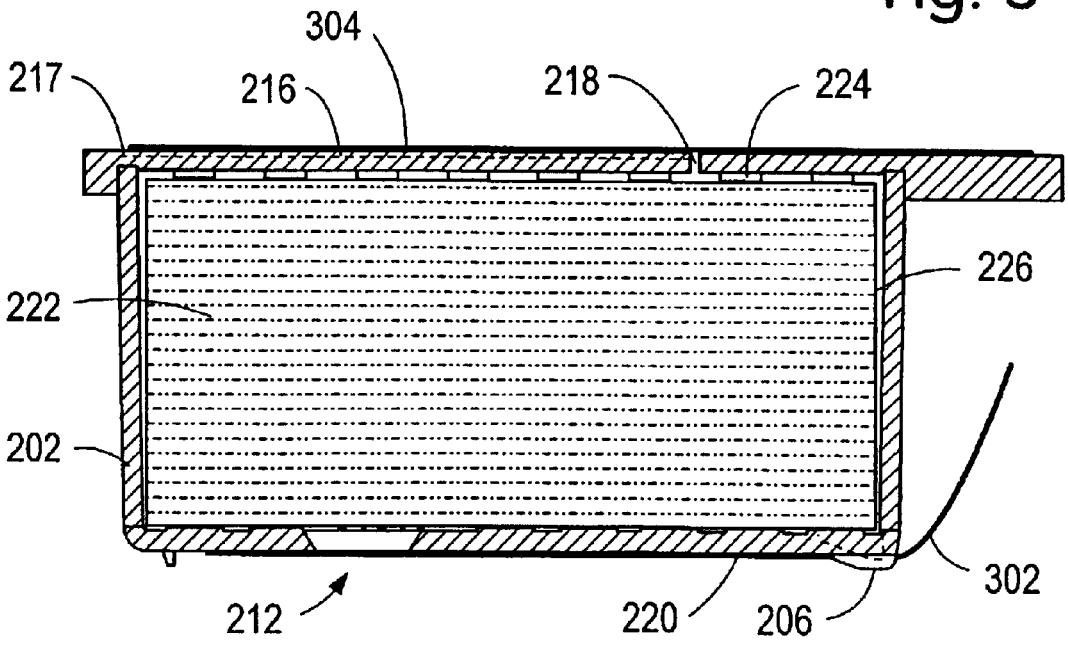
FIG. 5 is a cross-sectional view along line 5—5 of FIG. 3, illustrating an embodiment of the fluid interconnect port venting features of the present invention.

FIG. 5 is a cross-sectional view along line 5—5 of FIG. 3, further illustrating interior details of the exemplary fluid container. As seen in FIG. 5, the underside of the lid 212 includes spacing members 224, which may be in the form of castellations integrally molded with the lid. These spacing members serve to insure that air from the container vent may move into the capillary material 222, replacing ink as the ink is withdrawn from the container during printing. The spacing members also permit air to move to the end wall 226 of the container.

To provide a mechanism for air to pass from the top of the container around the capillary material 222, an embodiment of the invention contemplates exploiting a characteristic of the preferred capillary material, bonded polyester fiber (BPF). BPF is composed of multiple fiber strands bonded together, and as a result has a "grain", or preferred capillary direction, running the direction of the fibers. The fibers are oriented lengthwise in the container, as represented by the dashed lines in FIG. 5, such that an "end grain" of the material is adjacent to the container interior end wall 226. When the BPF material is in loose contact with the end wall 226 of the container, it has been empirically determined that sufficient air can flow along the end grain of the capillary material to meet the requirements of the fluid port vent, even when the capillary material is saturated with ink. If another capillary material is used in place of BPF (such as, for example, polyurethane foam or melamine), additional provisions for allowing air to pass from the top of the container around the capillary material may be required. The additional provisions may include vent channels (not shown) similar to the redundant vent channels 220 formed on the floor of the container.

In an embodiment of the invention, the interior of rear feet 206 may provide small air chambers too facilitate reliable air communication from the end of the container to the container floor.

To provide vent air paths from the container ends to the fluid interconnect port 212, small ribs 242 are formed on the floor of the container body 202 to space the capillary material slightly away from the floor of the container. To facilitate venting of the fluid interconnect port region, the ribs may be arrayed in a pattern forming rows substantially radial to the fluid interconnect port, as shown in FIG. 4.

The present invention thus provides a vent path for air to reach the fluid interconnect port to displace ink as the ink is drawn by capillary forces back into the capillary material (in the absence of a vent path, ink would be drawn into the capillary material only until the vacuum pressure in the port equaled the capillary forces acting on the ink). While the vent path should allow air to reach the fluid interconnect port, it has been empirically determined that the capacity and number of vent paths should be restricted in order to avoid several potential problems.

First, the fluid connection between the container 12 and the printing system relies on good contact between the mesh filter (113K through 113Y in FIG. 2) of the manifold tower (112K through 112Y of FIG. 2) and the ink-filled capillary material 222. If too large of a vent capacity is provided to the fluid interconnect port, this connection can be compromised, and the printing system can ingest air. In the absence of any venting of the fluid interconnect port, air replaces ink in the capillary material from the top of the container as ink in withdrawn from the bottom, with the capillary material near the interconnect port remaining heavily saturated with ink. If a large venting capacity is provided to the fluid interconnect port, ink can be depleted in the fluid interconnect region of the capillary material, as air locally replaces the ink. The result can be incomplete utilization of the ink within the container (the container may seem empty, while a substantial quantity of ink remains), and potential depriming of the ink delivery system.

Second, it has been empirically determined that if ink that is pooled in the fluid interconnect port adjacent to the label is withdrawn too quickly, isolated drops of ink may be left stranded on the label. These isolated drops form because the ink has inertia and may also slightly adhere to the label; the capillary forces and surface tension pull the surrounding ink out of the fluid port before the drops acquire sufficient velocity to exit the port. Once the ink surrounding the drops has been withdrawn, the forces which would normally act to pull the drops back into the container's capillary material are absent, and the drops remain on the label. When a customer removes the label to install the container in a printer, these drops may contact the customer's hands or clothing, or be flung off the label. It is therefore desirable to limit the vent capacity to slow the withdrawal of ink from the interconnect port. The capacities of the various venting mechanisms, such as the height and spacing of the ribs, are thus selected to provide adequate but limited venting of the fluid interconnect region.

Figure 6:
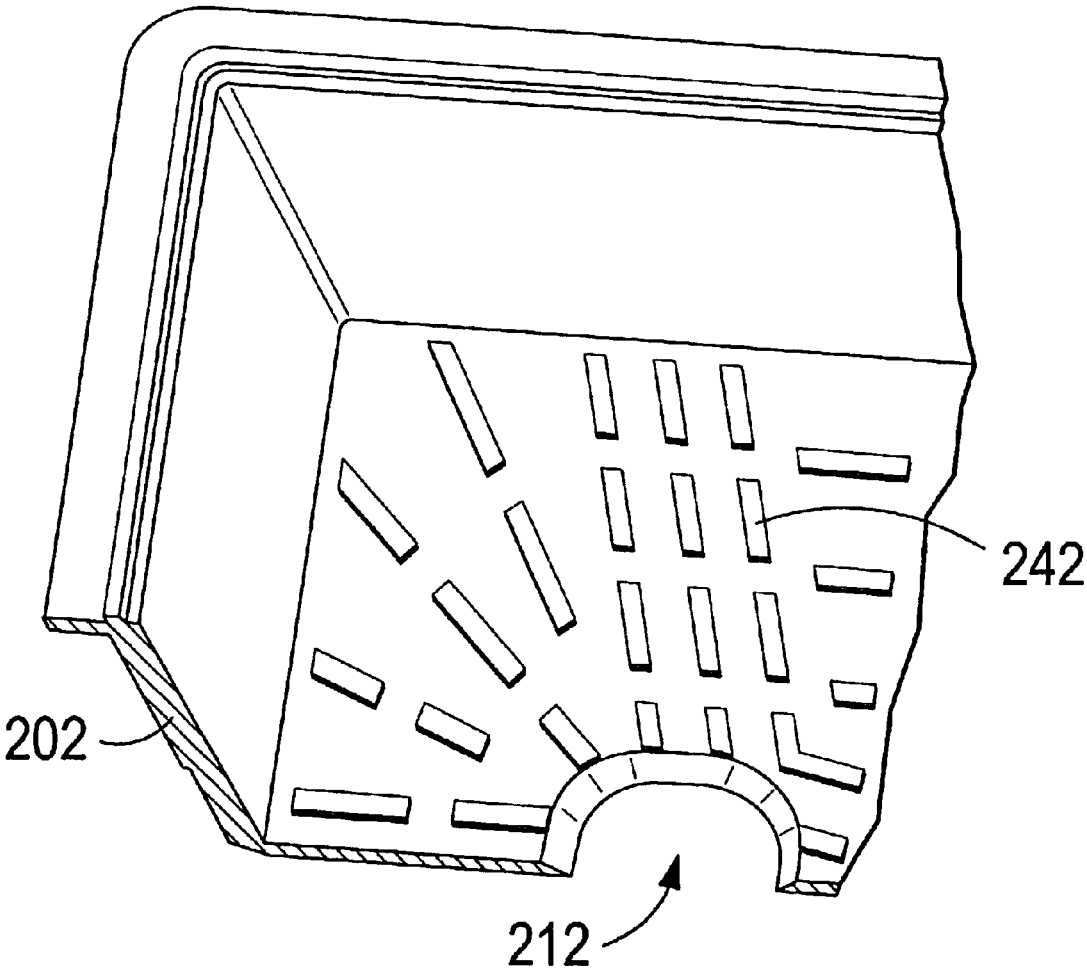
FIG. 6 is an enlarged view of a portion of the body of an embodiment of an ink container according to the invention, further illustrating the small ribs formed on the floor of the body.

FIG. 6 further illustrates the small ribs 242 formed on the floor of the ink container body 202. The ribs may be integrally formed with the body during an injection molding process. While a particular pattern, number, and orientation of ribs is shown, other patterns, numbers of ribs, and orientations may be utilized.

The methods of the present invention thus include venting a fluid container to ambient air with a vent located on the upper portion of the container; internally venting the container to channel air from the ambient air vent to an internal location adjacent to the fluid interconnect port; and venting the fluid port region utilizing small ribs to space the ink containing capillary material away from the container floor.

Although the exemplary embodiments of the invention relate to replaceable ink containers for inkjet printers, the present invention may be used for containers of other consumable liquids, and in other applications. Aspects of the venting mechanisms may also be used independently; such as, for example, utilizing restricted venting to slow down the adsorption of fluid into a capillary material to prevent formation of residual fluid drops or the depriming of a fluid delivery system, though the local source of vent air is provided through a mechanism other than disclosed herein. The invention may also be used with alternative fluid container designs, such as, for example, containers only partially filled with a capillary material.

While the present invention has been particularly shown and described with reference to the foregoing preferred and alternative embodiments, those skilled in the art will understand that many variations may be made therein without departing from the spirit and scope of the invention as defined in the following claims. This description of the invention should be understood to include all novel and non-obvious combinations of elements described herein, and claims may be presented in this or a later application to any novel and non-obvious combination of these elements. The foregoing embodiments are illustrative, and no single feature or element is essential to all possible combinations that may be claimed in this or a later application. Where the claims recite "a" or "a first" element of the equivalent thereof, such claims should be understood to include incorporation of one or more such elements, neither requiring nor excluding two or more such elements.

What is claimed is:

1. In a fluid reservoir having a substantially rigid outer shell with an upper portion and a lower portion, the shell enclosing an interior containing a capillary material and having a fluid interconnect port forming an opening through the rigid shell lower portion into the interior, a fluid port vent, comprising:

a reservoir vent in the top portion providing air communication between the shell interior and ambient air;

a venting mechanism in the reservoir interior providing air communication between the container vent and the container lower portion interior; and a plurality of ribs formed on the rigid shell lower portion serving to space the capillary materiel away from the lower portion and allow air venting to the fluid interconnect port, the plurality of ribs formed on the rigid shell lower portion arrayed in rows substantially radial to the fluid interconnect port.

2. The fluid port vent of claim 1 wherein the plurality of ribs formed on the rigid shell lower portion are integrally formed with the rigid shell lower portion.

3. The fluid port vent of claim 1 further comprising at least one foot integrally formed in the rigid outer shell lower portion, and wherein the venting mechanism in the reservoir interior further comprises a small air chamber in the rigid shell interior lower portion substantially conforming to the foot.

4. The fluid port vent of claim 1, wherein the venting mechanism in the reservoir interior comprises:

the substantially rigid outer shell further having at least one interior end wall, with the capillary material in loose contact with the interior end wall;

the capillary material having a preferred capillary direction;

the preferred capillary direction oriented substantially perpendicular to the rigid outer shell interior end wall, such that air may move along the shell interior end wall.

5. The fluid port vent of claim 4, wherein the capillary material comprises bonded polyester fiber (BPF).

6. In a fluid reservoir having a substantially rigid outer container with a top portion and a bottom portion, the container having an interior substantially filled with a capillary material, and a fluid interconnect port forming an opening through the outer container lower portion into the interior, a fluid port vent, comprising:

external venting means for providing air communication between the container interior and external ambient air;

interior reservoir venting means for providing air communication between the external venting means and an area adjacent to the fluid interconnect port; and spacing means radially arranged with respect to the fluid interconnect port and serving to space the capillary material sway from the lower portion and allow air venting to the fluid interconnect port.

7. A replaceable container for a consumable liquid, comprising:

a fluid reservoir having a substantially rigid outer container with a top portion and a bottom portion, the container having an interior substantially filled with a capillary material, and a fluid interconnect port forming an opening through the outer container lower portion into the interior;

a container vent in the top portion providing air communication between the interior and ambient air;

a venting mechanism in the reservoir interior providing air communication between the container vent to an area adjacent to the fluid interconnect port; and a plurality of ribs formed on the rigid shell lower portion serving to space the capillary material away from the lower portion and allow air venting to the fluid interconnect port, the plurality of ribs formed on the rigid shell lower portion arrayed in rows substantially radial to the fluid interconnect port.

8. The replaceable container for a consumable liquid of claim 7 wherein the plurality of ribs formed on the rigid shell lower portion are integrally formed with the rigid shell lower portion.

9. The replaceable container for a consumable liquid of claim 7 further comprising at least one foot integrally formed in the bottom portion, and wherein the venting mechanism in the reservoir interior comprises a small air chamber in the rigid container interior bottom portion substantially conforming to the foot.

10. The replaceable container for a consumable liquid of claim 7, wherein the venting mechanism in the reservoir interior comprises:

the substantially rigid outer container further having at least one interior end wall, with the capillary material in loose contact with the interior end wall;

the capillary material having a preferred capillary direction;

the preferred capillary direction oriented substantially perpendicular to the rigid container shell interior end wall, such that air may move along the container interior end wall.

11. The replaceable container for a consumable liquid of claim 10, wherein the capillary material comprises bonded polyester fiber (BPF).

12. A replaceable ink container for an inkjet printer, comprising:

a fluid reservoir having a substantially rigid outer container with a top portion and a bottom pardon, the container having an interior substantially filled with a capillary material, and a fluid interconnect port forming an opening through the outer container lower portion into the interior;

external venting means for providing air communication between the container interior and ambient air;

internal venting means for providing air communication between the external venting means and an area adjacent to the fluid interconnect port; and spacing means radially arranged with respect to the fluid interconnect port and serving to space the capillary material away from the lower portion and allow air venting to the fluid interconnect port.

13. A replaceable ink container for an inkjet printer, comprising:

a fluid reservoir having a substantially rigid outer container with a top portion and a bottom portion, the container flaying an interior substantially filled with a capillary material having a preferred capillary direction, and a fluid interconnect port forming an opening through the outer container lower portion into the interior;

a container vent in the top portion providing air communication between the interior and ambient air;

the substantially rigid outer container having at least one interior end wall, the capillary material in loose contact with the interior end wall, and with the capillary material preferred capillary direction oriented substantially perpendicular to the rigid container shell interior end wall, such that air may move along the container interior end wall;

a plurality of ribs integrally formed on the rigid shell lower portion serving to space the capillary material away from the lower portion and allow air venting to the fluid interconnect port, the plurality of ribs formed on the rigid shell lower portion arrayed in rows substantially radial to the fluid interconnect port.

14. The replaceable ink container for an inkjet printer of claim 13, wherein the capillary material comprises bonded polyester fiber (BPF).

15. A method of venting the fluid interconnect port of a fluid container, the container having an internal volume at least partially filled with a capillary material, with a fluid port substantially below the capillary material, the fluid port allowing fluid connection with the capillary material from outside of the container, the method comprising:

providing a vent to ambient air in an upper portion of the fluid container;

providing a mechanism for allowing air passage from the upper portion of the fluid container to below the capillary material;

providing spacing members radially arranged with respect to the fluid port to allow air flow between the container and capillary material to vent an area adjacent to the fluid interconnect port.

16. The fluid port vent of claim 15, wherein the step of providing spacing members to allow air flow between the container and capillary material is accomplished by providing integrally formed ribs in the container adjacent to the foam material.

17. A method of venting the fluid interconnect port of a fluid container, the fluid container having a substantially rigid outer shell with a upper portion, an interior substantially filled with a capillary material, a lower portion, and a fluid interconnect port forming an opening through the outer container lower portion into the interior, the method comprising:

venting the fluid container to ambient air with a vent located on the upper portion of the container;

internally venting his container to channel air from the ambient air vent to an internal location adjacent to the fluid interconnect port; and providing spacing members radially arranged with respect to the fluid port to allow air flow between the container and capillary material to vent an area adjacent to the fluid interconnect port.

18. The method of venting the fluid interconnect port of a fluid container of claim 17, wherein the step of providing spacing members to allow air flow between the container and capillary material is accomplished by providing integrally formed ribs in the container adjacent to the foam material.

* * * * *